US005553759A

United States Patent [19]

McMaster et al.

[11] Patent Number: 5,553,759

[45] Date of Patent: Sep. 10, 1996

[54] BACKPACK ASSEMBLY

[75] Inventors: James McMaster; Michael Petersen, both of Florence, S.C.

[73] Assignee: The Coleman Company, Inc., Wichita, Kans.

[21] Appl. No.: 273,879

[22] Filed: Jul. 12, 1994

[51] Int. Cl.[6] ..... A45F 3/08; A45F 3/10

[52] U.S. Cl. ..... 224/631; 224/259; 224/261; 224/264; 224/635; 224/637; 224/643; 224/644

[58] Field of Search ..... 224/209, 210, 224/211, 212, 213, 215, 216, 259, 261, 262, 263, 264

[56] References Cited

U.S. PATENT DOCUMENTS

| | | | |
|---|---|---|---|
| D. 224,631 | 8/1972 | Morris . | |
| 3,938,718 | 2/1976 | Madison . | |
| 4,169,550 | 10/1979 | Williams . | |
| 4,420,103 | 12/1983 | Douglass | 224/209 |
| 4,479,595 | 10/1984 | Opsal | 224/211 |
| 4,676,418 | 6/1987 | Lowe . | |
| 4,750,654 | 6/1988 | Menetrier . | |
| 4,842,173 | 6/1989 | Scherer | 224/210 |
| 4,934,573 | 6/1990 | Jaeger . | |
| 5,004,135 | 4/1991 | DuFournet et al. | 224/210 |
| 5,236,112 | 8/1993 | Robinson et al. | 224/210 |
| 5,240,159 | 8/1993 | Gregory . | |
| 5,284,279 | 2/1994 | Sason et al. | 224/209 |
| 5,361,955 | 11/1994 | Gregory | 224/211 |

FOREIGN PATENT DOCUMENTS

| | | | |
|---|---|---|---|
| 2646998 | 11/1990 | France | 224/209 |
| 2662341 | 11/1991 | France | 224/211 |
| 2716260 | 3/1977 | Germany . | |
| 3844675 | 6/1990 | Germany | 224/211 |
| 43632 | 1/1927 | Norway | 224/261 |
| 2223930 | 4/1990 | United Kingdom | 224/211 |
| WO87/01017 | 2/1987 | WIPO . | |

OTHER PUBLICATIONS

Big Pack Catalog, pp. 39–41.

Photograghs A–J of a Camp Trails Frame.

*Primary Examiner*—Henry J. Recla
*Assistant Examiner*—Charles R. Eloshway

[57] ABSTRACT

A backpack frame is molded integrally from composite fiber and resin material to provide a light yet strong frame. The frame includes top and bottom members and a pair of side members. A pair of vertical ribs extend between the top and bottom members, and a plurality of horizontal members extend between the side members. The frame has torsional flexibility about a longitudinal axis which is generally parallel to the side members. Each of the ribs has a generally kidney-shaped cross section which is provided by a groove in the rib. A sack is slidably attached to the frame by elongated beaded attaching members which are sewn to the sack. Each bead is slidably inserted into a key-hole shaped channel in one of the side members. A suspension system includes shoulder straps, a waist belt, and a back pad. Each part of the suspension is formed from closed cell foam which is compression molded to form air-circulating grooves. One or both sides of the foam has a flame laminated skin.

6 Claims, 6 Drawing Sheets

BACKPACK ASSEMBLY

BACKGROUND

This invention relates to backpacks, and, more particularly, to a lightweight yet strong, anatomically shaped frame, a sack which is slidably attached to the frame, and a compression molded suspension system.

Backpacks are used by hikers, mountain climbers, campers, etc. for carrying camping gear, clothing, food, and the like. Backpacks fall into two broad categories—external frame backpacks and internal frame backpacks. An external frame backpack includes a frame and a separate sack which is removably mounted on the frame. An internal frame backpack includes a sack with frame structure which is integrated into the inside of the sack.

The sack of an external frame backpack is commonly attached to the frame by steel pins which are inserted through the frame and into grommets which are attached to the sack. When the sack is filled, the weight of the contents applies forces at the grommets which are point stresses. The areas of the sack where the grommets are attached therefore require costly reinforcement construction.

Weight and strength are important characteristics of a backpack frame. The frame should be light yet strong. The frame should also be shaped to fit the anatomy of the backpacker. Some frames are constructed so rigidly that the frames have little or no torsional flexibility which permits the frame to flex with movements of the body.

The suspension system of a backpack commonly includes a pair of shoulder straps, a waist belt, and a back pad. The suspension system should be adjustable to accommodate various torso shapes and should comfortably support the load on the backpacker.

SUMMARY OF THE INVENTION

The invention provides a strong, lightweight, anatomically shaped backpack frame which is molded integrally from composite fiber and resin material. The curved shape of the frame conforms to the curvature of the human spine and enables loads to be placed close to the body. The frame can flex torsionally, yet provides a rigid support for the load. The shape of the frame also shapes the sack and spaces the sack from the body for permitting air circulation. The cross ribs of the frame have a substantially round cross section, and a groove in each rib provides an I beam effect for strengthening the rib. Intersections between frame members are radiused to prevent concentration of stresses.

The sack is slidably attached to the frame by elongated beaded attaching members which are stitched between panels of the sack. The bead of each attaching member slides into a channel in one of the side members of the frame. The load of the sack is distributed along the entire length of the attaching members rather than being concentrated at discrete locations.

The suspension system is formed from compression molded closed cell foam. Air circulation grooves are molded into one side of the foam, and the grooved side includes a flame laminated skin. Internal voids are molded in specific locations, creating air cells for comfort and shock absorption.

DESCRIPTION OF THE DRAWING

The drawing will be explained in conjunction with illustrative embodiments shown in the accompanying drawing, in which.

DESCRIPTION OF SPECIFIC EMBODIMENT

Figure 1:
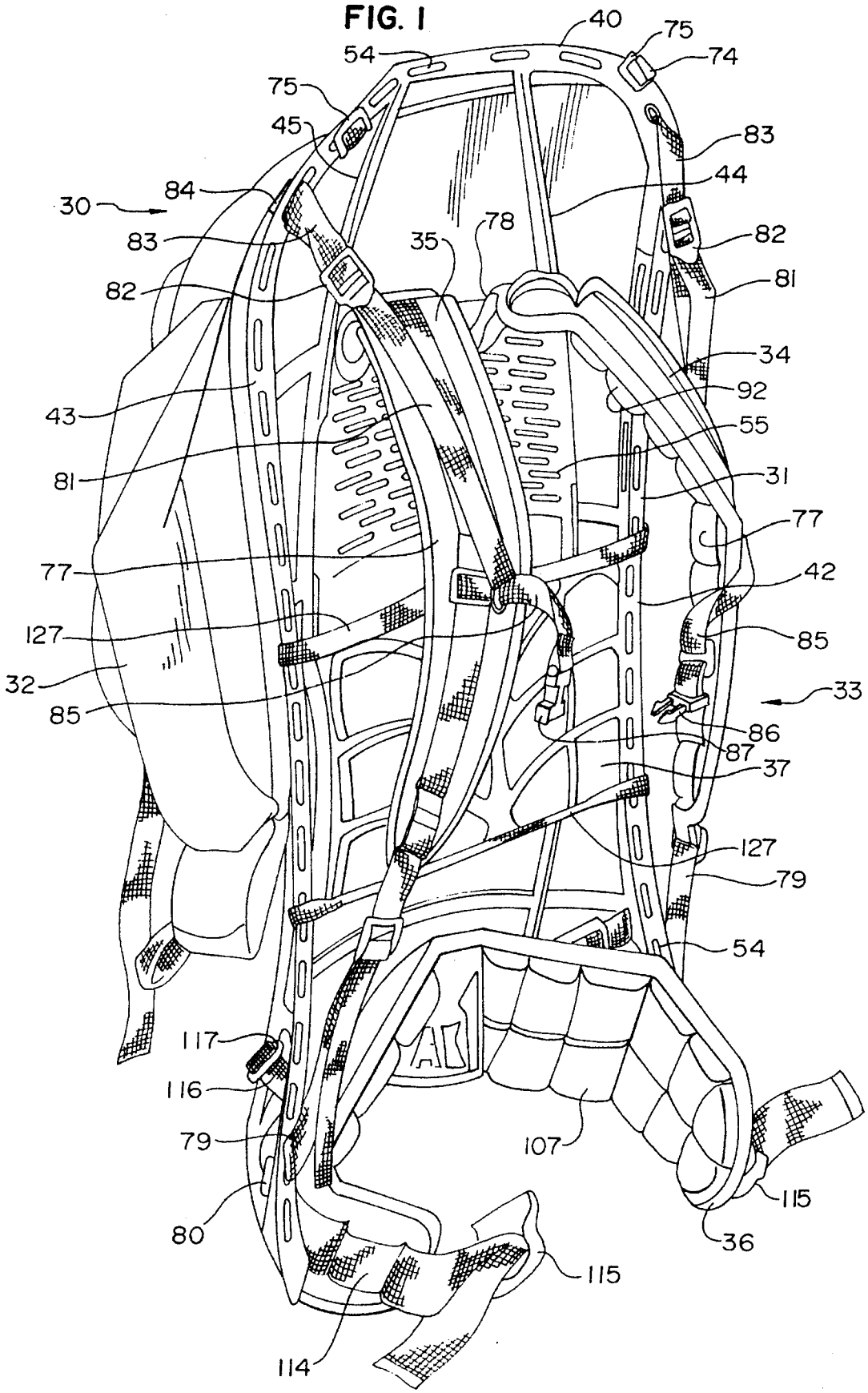
FIG. 1 is a perspective view of a backpack assembly in accordance with the invention.

Referring to FIG. 1, a backpack assembly 30 includes a frame 31 and a sack 32. The sack is removably secured to the frame in a manner which will be described hereinafter. A suspension assembly 33 is also removably attached to the frame for mounting the backpack on a user. The suspension assembly includes a pair of shoulder straps 34 and 35, a waist belt 36, and a back pad 37.

The details of the frame 31 are shown in FIGS. 2–12. The frame is integrally molded from composite material to provide a strong yet light frame. The preferred composite material is Kevlar fibers and resin. However, graphite or glass fibers could also be used. Nylons, polypropylenes, and urethanes can also be added to the composite material if desired.

The frame includes top and bottom frame members 40 and 41 and side frame members 42 and 43. A pair of vertical ribs 44 and 45 extend between the top and bottom members, and four horizontal ribs 46, 47, 48, and 49 extend between the side members. A slotted panel 50 is formed integrally in the area bounded by the ribs 44, 45, 46, and 47.

Figure 2:
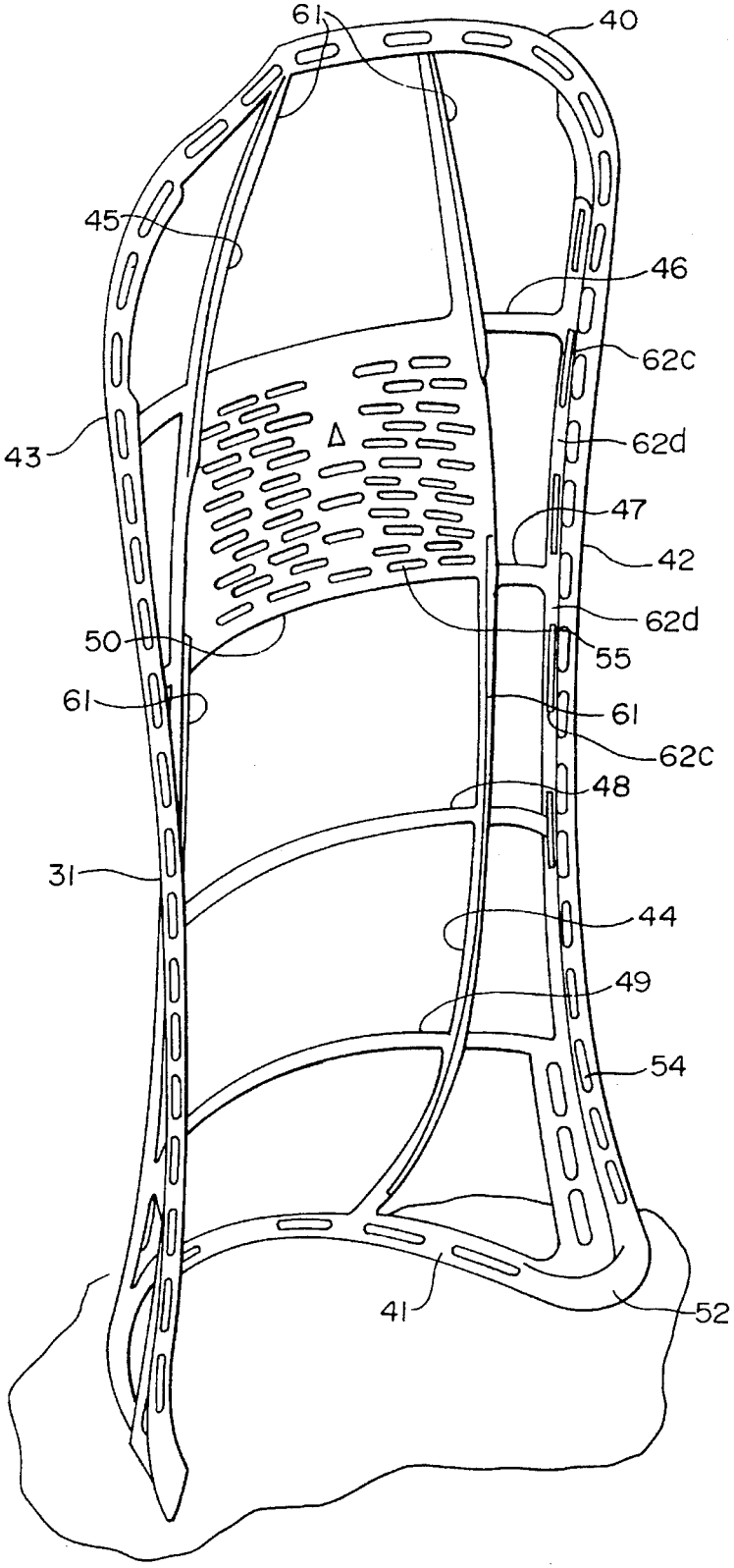
FIG. 2 is a perspective view of the backpack frame.
Figure 3:
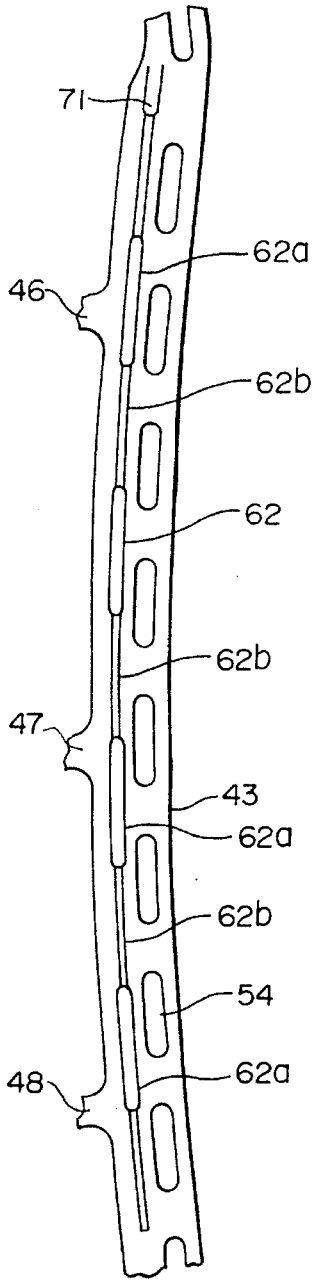
FIG. 3 is an enlarged fragmentary view of a side portion of the frame.

The frame has an inside surface 52 which is illustrated in FIG. 2 and which is adapted to face the back of the user. An outside surface 53 (FIG. 4) engages the sack 32.

Figure 5:
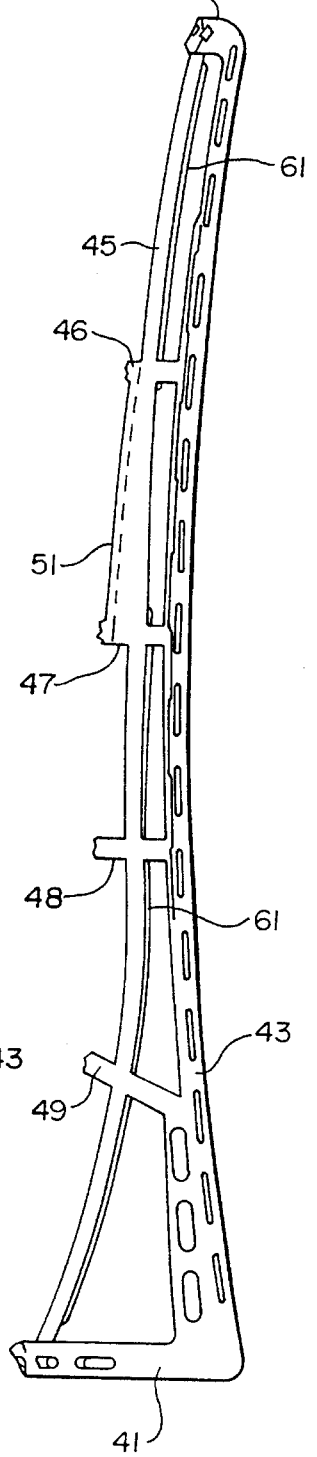
FIG. 5 is a side elevational view of the frame.
Figure 8:
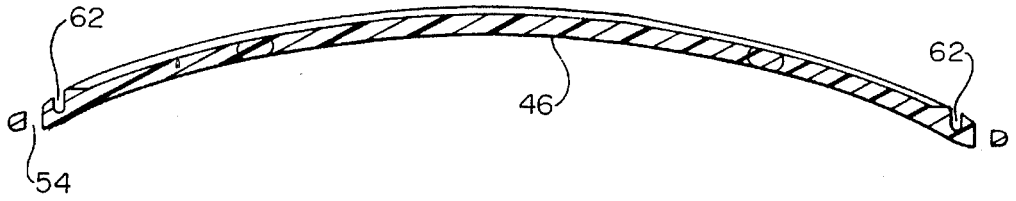
FIG. 8 is a sectional view taken along the line 8—8 of FIG. 4.
Figure 7:
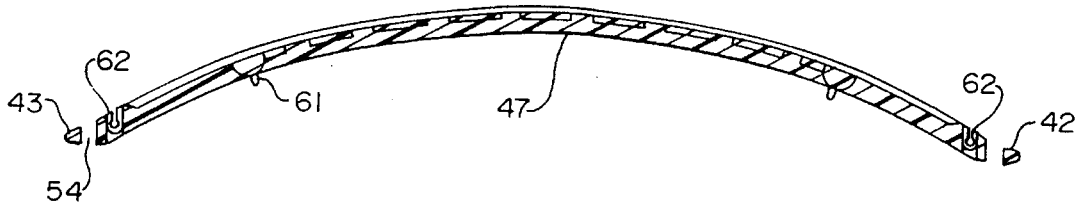
FIG. 7 is a sectional view taken along the line 7—7 of FIG. 4.
Figure 6:
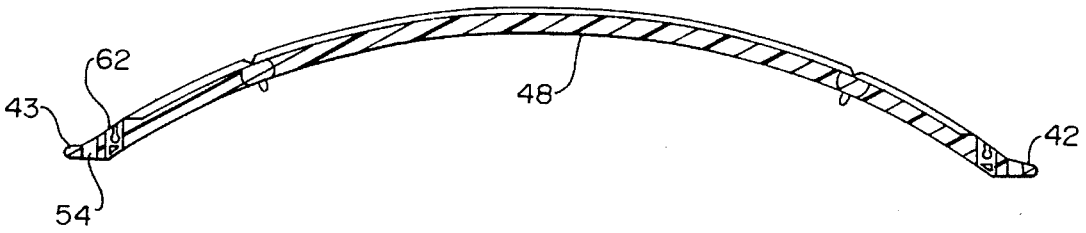
FIG. 6 is a sectional view taken along the line 6—6 of FIG. 4.

The frame is anatomically shaped to conform to the shape of the human spine. Referring to FIG. 5, the side members 42 and 43 curve inwardly from the top member 40 and then curve outwardly so that the bottom end of each side member is positioned inwardly of the top end. The side elevational contour of the vertical ribs 44 and 45 follows the contour of the side members down to the horizontal rib 48. The lower portions of the vertical ribs curve outwardly to accommodate the buttocks of the user.

Figure 4:
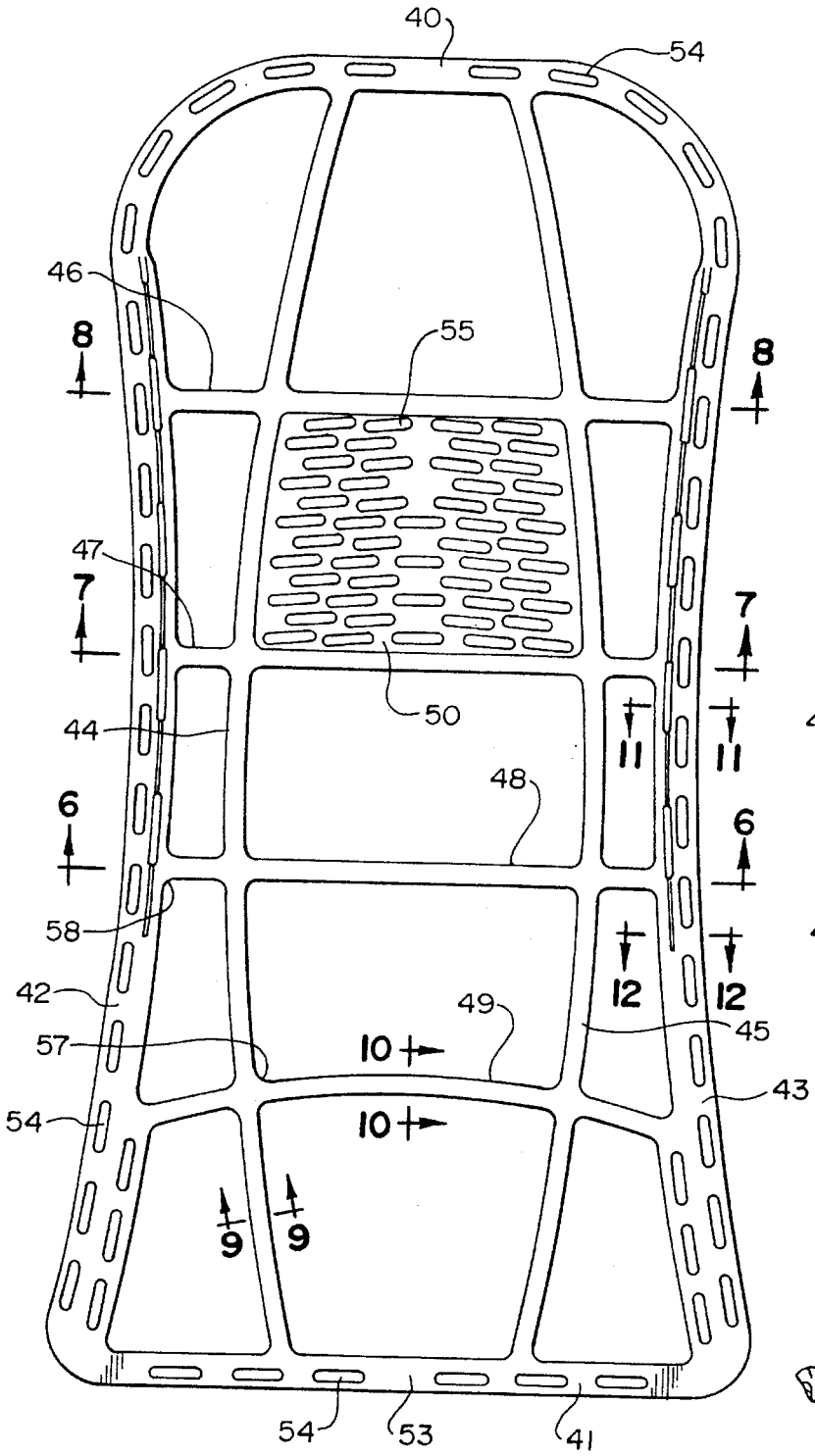
FIG. 4 is an elevational view of the outside surface of the frame.

Referring to FIG. 4, the midportions of the side members 42 and 43 curve laterally inwardly, and the bottom portions curve outwardly to accommodate the buttocks. The vertical ribs 44 and 45 are bow-shaped and are closest to the side members in the middle of the frame.

The horizontal ribs 46–49 curve outwardly between the side members 42 and 43 and between the vertical ribs 44 and 45 (FIGS. 5–8). The bottom rib 49 is also angled upwardly (FIG. 5) to accommodate the buttocks.

The top and bottom members 40 and 41 and the side members 42 and 43 are relatively flat and are provided with a plurality of elongated slots 54. The panel 50 is also provided with a plurality of slots 55. The slots are provided in accordance with the teaching of U.S. Pat. No. 3,938,718 for attaching the suspension system to the frame.

The intersections between the vertical and horizontal ribs are radiused in three dimensions. See, for example, the radius or fillet 57 in FIG. 4 where the rib 44 intersects the rib 49. The intersections between the vertical ribs and the top and bottom members and the intersections between the horizontal ribs and the side members are also radiused in three dimensions. See, for example, the radius 58 where the rib 48 intersects the side member 42. The radiused intersections eliminate stress concentrations.

Figure 9:
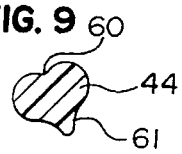
FIG. 9 is a sectional view taken along the line 9—9 of FIG. 4.
Figure 10:
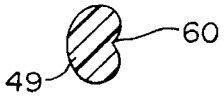
FIG. 10 is a sectional view taken along the line 10—10 of FIG. 4.

Referring to FIGS. 9 and 10, each of the vertical and horizontal ribs has a substantially rounded periphery and includes a longitudinally extending groove or channel 60 which provides the rib with a kidney-shaped cross section having a rounded contour. The groove increases the surface area of the rib and increases the load resistance of the rib when shearing forces are applied in a manner similar to an I beam. The upper and lower ends of the vertical ribs are further reinforced by a ridge or projection 61 (FIGS. 2 and 5) on the inner surface of the rib.

Figure 11:
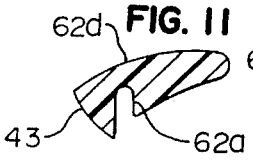
FIG. 11 is a sectional view taken along the line 11—11 of FIG. 4.
Figure 12:
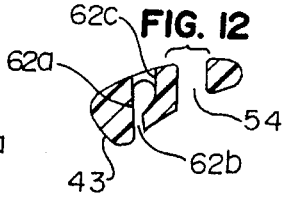
FIG. 12 is a sectional view taken along the line 12—12 of FIG. 4.

Each of the side members 42 and 43 is provided with a channel 62 (FIGS. 3 and 4) which permits a sliding attachment between the sack 32 and the frame. Referring to FIGS. 11 and 12, each channel has a generally keyhole-shaped cross section and includes a main channel portion **62*a* and a restricted mouth portion 62*b* which is narrower than the main portion 62*a*. In order to mold the channel into the frame, each channel includes a plurality of interrupted or spaced-apart mouth portions, and the bottom of the channel has a slot 62*c* (FIG. 12) below each mouth portion. The bottom of the channel is closed by a bottom wall 62*d* (FIG. 11**) in the portions of the channel which do not have a mouth portion. The channel can be molded into the frame by using alternating shutoffs on opposite sides of the frame which allow the mold material to flow around and form the channel.

Figure 21:
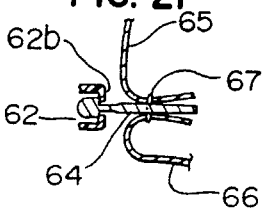
FIG. 21 is a fragmentary sectional view of the sack and the attaching tab.
Figure 22:
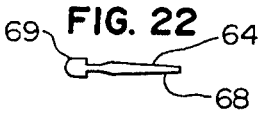
FIG. 22 is an end view of the attaching tab.
Figure 23:
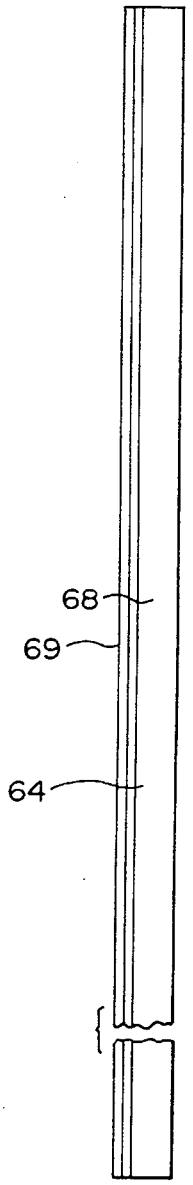
FIG. 23 is a side elevational view, partially broken away, of the attaching tab.

Attachment of the sack 32 to the frame is accomplished by a pair of beaded tabs 64 (FIGS. 20–23) which are sewn into seams in the sack. The sack includes a back panel 65 (FIG. 21), and a pair of side panels 66. A tab 64 is inserted between each of the side panels and the back panel, and the panels and the tabs are secured by stitching 67.

Each tab is elongated and extends for substantially the entire height of the sack. The tab is advantageously extruded from plastic. The tab includes a flat attaching portion 68 and an enlarged head portion 69. The head is sized to be slidable within the main portion **62*a* of the channels 62 and retained by the mouth portion 62*b***.

Each channel includes an open entryway 71 (FIGS. 3 and 20) so that the bead 69 of the tab can be inserted into the channel. The sack is quickly and easily secured to the frame by sliding the tabs into the channels.

The load of the sack is distributed along the entire length of the tabs 64 and is supported by the corresponding portions of the side members of the frame. The stress concentrations which are created by the prior grommet and pin connections are thereby eliminated.

If desired, the top of the sack can also be secured to the frame by a pair of looped straps 74 (FIG. 1) and a buckle 75 carried by each of the straps. The buckle 75 is inserted through one of the slots 54 in the top of the frame and then turned to prevent withdrawal of the buckle as taught by U.S. Pat. No. 3,938,718.

The suspension assembly 33 is also removably attached to the frame in accordance with U.S. Pat. No. 3,938,718. Referring to FIG. 1, each of the shoulder straps 34 and 35 includes a pad 77 and upper and lower straps 78 and 79. A buckle 73 is carried by each of the straps 78, and each buckle is inserted through one of the slots 55 in the panel 50 to secure the strap to the frame. Similarly, a buckle 80 is attached to each of the lower straps 79, and the buckles are inserted through one of the slots 54 in the lower portions of the side frame members 42 and 43.

A load control strap 81 is attached to the top surface of each of the shoulder pads, and the upper end of each load control strap is adjustably secured to a buckle 82. The buckle 82 is attached to the frame by a looped strap 83 and a buckle 84 on the strap which is inserted through one of the slots 54 in the top frame member 40. A chest strap 85 is adjustably attached to the top of each shoulder pad, and the chest straps can be connected by male and female quick release buckles 86 and 87.

Figure 24:
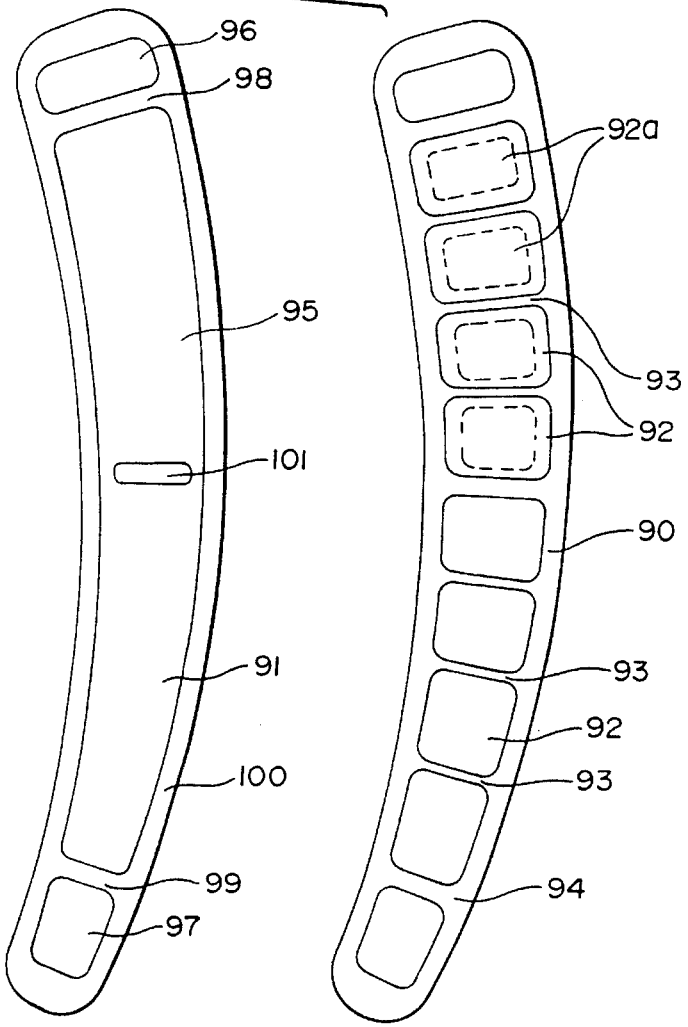
FIG. 24 is a view of the two halves of one of the shoulder straps.

With the exception of the manner in which the shoulder pads are formed, the foregoing shoulder harness is conventional and well known. Referring to FIG. 24, each of the shoulder straps is formed from a bottom half 90 and a top half 91. Each half is formed from ½ inch closed cell EVA foam with a flame-laminated fabric skin on the outside surface. The flame-laminating technique is conventional and well known.

The bottom half 90 is compression molded to form a plurality of foam pads 92 on the outer skinned side which are separated by compressed areas or grooves 93. The unskinned side contains a variety of compression areas **92*a* to create air cells when the top and bottom halves of the shoulder harness are assembled. A compressed edge portion 94** extends around the periphery of the part.

The top half 91 is compression molded to form to an elongated central pad 95 and a pair of end pads 96 and 97 which are separated by compressed areas 98 and 99. A compressed edge portion 100 extends around the periphery of the part. A compressed area 101 in the middle of the pad 95 facilitates stitching the load control strap 81 to the shoulder pad.

The two halves 90 and 91 are superimposed, the edges are covered with fabric trim, and the assembly is secured by stitching the compressed edge portions together.

Figure 13:
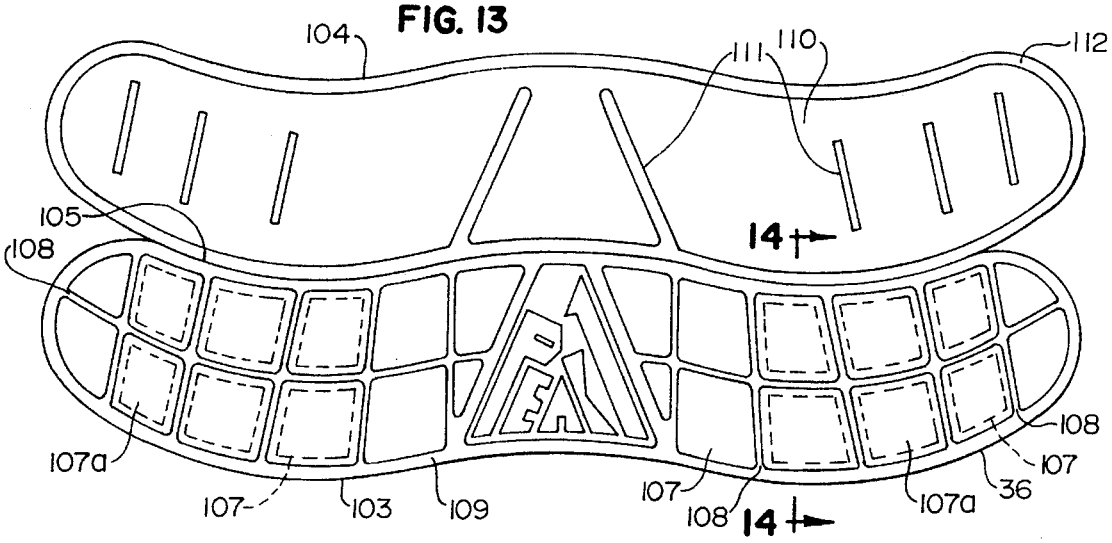
FIG. 13 is a plan view of the two halves of the waist belt.
Figure 14:
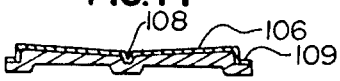
FIG. 14 is a sectional view taken along the line 14—14 of FIG. 13.

The waist belt 36 is similarly formed from compression molded EVA foam. Referring to FIG. 13, inner and outer halves 103 and 104 of the belt are joined along a fold line 105. The surfaces which face the viewer in FIG. 13 are covered with a flame laminated fabric skin 106 (FIG. 14).

The lower half is compression molded to form pads 107 which are separated by compressed areas or grooves 108 and a compressed edge portion 109. The unskinned side contains a variety of compression areas 107*a* to create air cells when the inner and outer halves of the waist belt are assembled. The upper half is also compression molded to form a large central pad 110, compressed areas 111, and a compressed edge portion 112. The two halves are folded together and the edges are covered with fabric trim and stitched together.

A strap 114 (FIG. 1) is secured to the outside of the waist belt by stitching which passes through the compressed areas of the belt. The ends of the strap can be secured by quick release buckles 115.

The belt is removably secured to the frame by straps 116 and buckles 117 on the straps which are inserted through slots 54 in the frame. The straps 116 are stitched to the strap 114.

Figure 15:
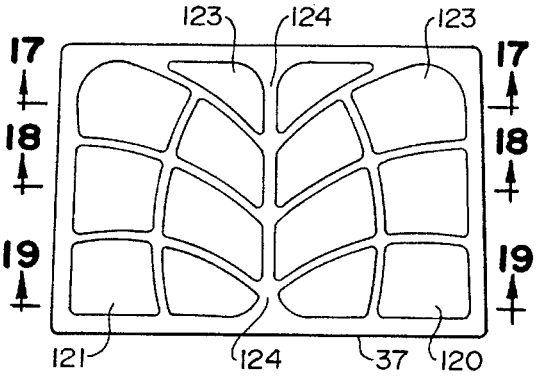
FIG. 15 is a plan view of the back surface of the back pad.
Figure 16:
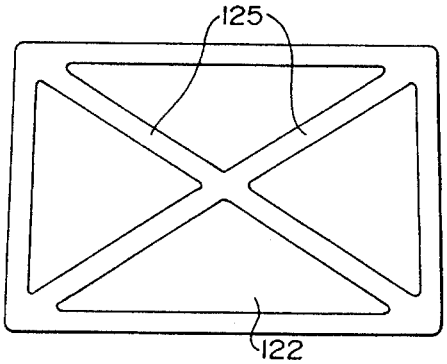
FIG. 16 is a plan view of the front surface of the back pad.
Figure 17:
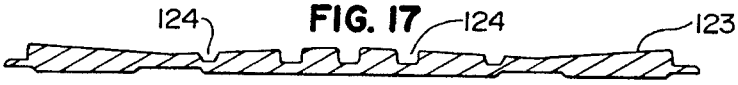
FIG. 17 is a sectional veiw taken along the line 17—17 of FIG. 15.
Figure 18:
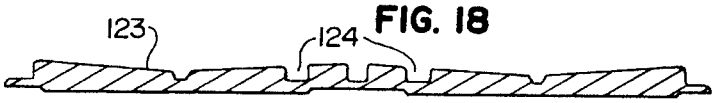
FIG. 18 is a sectional veiw taken along the line 18—18 of FIG. 15.
Figure 19:
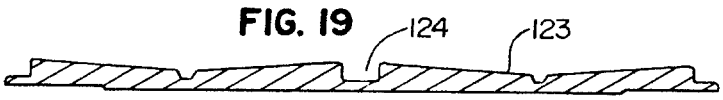
FIG. 19 is a sectional veiw taken along the line 19—19 of FIG. 15.
Figure 20:
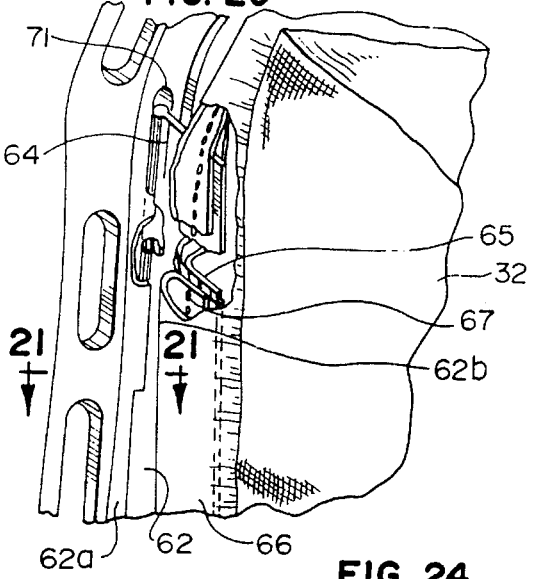
FIG. 20 is a fragmentary sectional view showing the attachment of the sack to the frame.

The back pad 37 is also formed from ½ inch EVA foam. Referring to FIG. 15, the inside surface 120 is covered with a flame laminated fabric skin 121, and the outside surface 122 (FIG. 116) is unskinned. The back pad is compression molded to form pads 123 in the inner surface which are separated by compressed grooves 124 and crisscrossing compressed grooves 125 in the outer surface.

Straps 127 (FIG. 1) are stitched to the top and bottom edges of the back pad. The straps are inserted through slots 54 in the frame, and the upper left strap end is attached to the lower right strap end by a buckle. Similarly, the upper right strap end is attached to the lower left strap end by a buckle. The crisscrossing compressed grooves 125 in the outer surface of the pad accommodate the crisscrossing straps.

The backpack frame is lightweight, adjustable, and ergonomically shaped. The curved shape of the frame conforms to the curvature of the human spine, which enables heavy loads to be placed in close proximity to the body of the user. When mounted on the body, the frame can flex torsionally about a longitudinal axis which extends generally parallel to the side frame members 42 and 43 and the vertical ribs 44 and 45 while staying rigid in the vertical plane. Torsional flexing permits the frame to move with movements of the body while still providing a rigid support for the load in the sack.

The torsional flexiblity of the frame permits, for example, the upper right portion of the frame to twist or rotate relative to the bottom left portion of the frame about the longitudinal axis. Also, the curved horizontal ribs 46–49 permit some flexing to allow the side frame members to move closer together. However, the vertical ribs 44 and 45 substantially inhibit flexing of the frame about an axis which extends perpendicularly to the vertical ribs and the side frame members.

The lightweight yet high strength of the frame is provided by the use of composite fiber material. Without the use of composite fiber material, the frame would require a different structural design which would use a greater volume of material to maintain the same strength characteristics.

Weight and strength characteristics are important and necessary when a backpacker is carrying heavy supplies, survival gear, etc. for long distances into desolate areas for extended periods of time. The lightweight composite materials have a high strength-to-weight ratio which enables a backpacker to carry increased loads.

Compared to aluminum or steel frames, the inventive frame is comparable in weight and in some cases lighter. Aluminum and steel frames are stiff and will not conform to the movement of the body during hiking. The inventive frame allows greater freedom of movement, which increases comfort while maintaining structural integrity to support heavier loads. The inventive frame, because of its lightweight and torsional flexibility, actually reacts like an internal frame pack which conforms and moves with the human torso.

Unlike other external frame backpacks, the inventive frame uses part of its structure to shape the back of the sack. This shaping prevents contact with the body and provides a narrow boundary through which air can flow to reduce perspiration. Referring to FIG. 5, the horizontal ribs 46–49 curve outwardly from the side frame members 43 and 44 to space the vertical ribs 44 and 45 outwardly from the side frame members, and the horizontal ribs also curve outwardly between the vertical ribs. The sack is thereby spaced outwardly from the body.

Spacing of the frame and the sack from the lumbar region of the back is also accomplished by the back pad 37. The back pad can be adjusted to extend fairly tautly between the side frame members.

The compression molded, flame-laminated suspension parts also allow for air circulation between the body and the suspension system. The voids and spaces provided by the compressed or grooved areas of the suspension parts create air channels for air circulation. The flame laminated skin eliminates slippage of the foam material and reduces abrasion against the body.

The quick slide attachment of the sack to the frame allows the backpacker to install or detach a pack in seconds. Further, since the sack is supported along the entire length of the beaded attachment tab, the load of the sack is distributed along the length of the tab. The point stresses which are caused by pin and grommet connections are therefore avoided.

While in the foregoing specification, a detailed description of a specific embodiment of the invention was set forth for the purpose of illustration, it will be understood that many of the details herein given may be varied considerably by those skilled in the art without departing from the spirit and scope of the invention.

We claim:

1. A backpack assembly comprising:

a frame having top and bottom frame members and a pair of side frame members which extend between the top and bottom frame members, each of the side frame members having an elongated longitudinal channel therein, a sack having a pair of elongated attaching members secured thereto, each of the attaching members being slidably received in one of the channels, and each of said channels having a generally keyhole-shaped transverse cross section, each said channel being provided in a main channel portion having:

a pair of opposed side walls which form a plurality of restrictive mouth portions, said mouth portions spaced longitudinally along said main channel portion; and, a plurality of longitudinally spaced bottom walls connecting said side walls and located at portions of the channel between said mouth portions, said mouth portions located at portions of the channel between said bottom walls; whereby, said channel can be injection molded in the side member of the frame.

2. The backpack assembly of claim 1 in which each of the attaching members comprises an elongated tab having a flat attaching portion which is secured to the sack and an enlarged bead portion which is slidably received in one of the channels.

3. The backpack assembly of claim 2 in which the sack includes a back panel and a pair of side panels, each of the side panels being secured to the back panel along a seam, the flat attaching portion of each of the tabs being inserted into one of the seams between the back panel and one of the side panels, and stitching which connects the back panel, flat attaching portion of the tab, and the side panel.

4. The backpack assembly of claim 1 including a waist belt attached to the frame, the waist belt including a foam body and a flame laminated skin on one side of the foam body, the skin side of the foam body having a plurality of flat compressed portions providing flat grooves for allowing air circulation between the belt and a user.

5. The backpack assembly of claim 1 including a back pad attached to the side members, the back pad including a foam body and a flame laminated skin on one side of the foam body, the skin side of the foam body having a plurality of flat compressed portions providing flat grooves for allowing air circulation between the back pad and a user.

6. The backpack assembly of claim 1 including a pair of shoulder straps attached to the frame, each of the shoulder straps including a foam body and a flame laminated skin on at least one side of the foam body, the skin side of the foam body having a plurality of flat compressed portions providing flat grooves for allowing air circulation between the shoulder strap and a user.

* * * * *